United States Patent [19]

Alexander et al.

[11] Patent Number: 4,871,210

[45] Date of Patent: Oct. 3, 1989

[54] CHILD HOLDER

[76] Inventors: Cynthia R. Alexander, 10 Sherburne Hills Rd., Danville, Calif. 94526; Dianne J. Pollard, 69 Jackson Way, Alamo, Calif. 94507

[21] Appl. No.: 207,777

[22] Filed: Jun. 16, 1988

[51] Int. Cl.[4] ..... A47D 1/10

[52] U.S. Cl. ..... 297/435; 297/254; 297/467; 297/484

[58] Field of Search ..... 297/250, 254, 255, 256, 297/464, 467, 484, 485

[56] References Cited

U.S. PATENT DOCUMENTS

| | | | |
|---|---|---|---|
| 1,205,384 | 11/1916 | Peck . | |
| 1,376,625 | 5/1921 | Johnston . | |
| 1,934,615 | 11/1933 | Selverstone | 297/229 |
| 2,404,108 | 7/1946 | Stauffiker . | |
| 2,451,007 | 10/1948 | White . | |
| 2,652,183 | 9/1953 | Hliuka | 297/485 X |
| 2,954,070 | 9/1960 | Moeller | 297/250 X |
| 3,604,750 | 9/1971 | Doering | 297/485 X |
| 3,713,692 | 1/1973 | McCracken . | |
| 3,779,599 | 12/1973 | Gottfried | 297/484 X |
| 4,235,474 | 11/1980 | Rosenberg | 297/485 X |
| 4,428,514 | 1/1984 | Elf | 297/467 X |
| 4,592,589 | 6/1986 | Helling | 297/216.3 X |
| 4,702,523 | 10/1987 | Schrader et al. | 297/485 |

FOREIGN PATENT DOCUMENTS

| | | | |
|---|---|---|---|
| 649206 | 5/1985 | Fed. Rep. of Germany . | |
| 1173891 | 12/1969 | United Kingdom | 297/484 |
| 1590172 | 5/1981 | United Kingdom . | |

*Primary Examiner*—Peter R. Brown

*Attorney, Agent, or Firm*—Philip A. Dalton

[57] ABSTRACT

A child holder includes a halter which incorporates crotch, abdomen and shoulder straps and is readily adjusted to fit seat backs of different sizes and to accommodate children of different sizes, and an integral, separate or separable booster seat.

15 Claims, 4 Drawing Sheets

CHILD HOLDER

BACKGROUND OF THE INVENTION

The present invention relates to a harness for securely and comfortably holding children or the infirm in a sitting position in chairs and, in addition, to a holder which combines the harness with an integral or removable booster seat.

STATE-OF-THE-ART OF RELEVANT HUMAN SEAT RESTRAINTS

The available harnesses for holding persons (either children or the infirm) in chairs typically comprise straps or sheets which are secured to the chair.

For example, Peck U.S. Pat. No. 1,205,384 diaper-like sheet having a seat region and cutouts for the legs, as well as tie cords secured to the four corners of the sheet for tying it to chairs.

Carpenter British Pat. No. 1,590,172 and German Pat. No. 649,206 both disclose restraints comprising seat back pocket and a crotch strap which extends from the pocket between the legs to form a front panel having lateral belts or straps which are attached or tied behind the associated chair back. The British '172 patent also mentions the use of crossed shoulder straps.

Deering U.S. Pat. No. 3,604,750 discloses a restraint comprising an elongated sheet which is folded over the back of a chair and has a seat portion and a multiplicity of ties and straps extended from its sides, as well as a front crotch flap which is retained by two of the lateral straps. These two abdomen straps are, in turn, retained by crossed shoulder straps. The several abdomen straps extend through slots in the back of the panel for attachment.

SUMMARY OF THE INVENTION

It is one object of the present invention to provide a holder structure which is readily adjusted to fit children of different sizes and to allow varying freedom of movement and which is also adapted to chairs of varying sizes, yet is relatively simple and easy to use and to adjust.

It is a related object to provide such a halter for comfortably and adjustably securing the individual via the crotch, abdomen and neck/shoulders and which is adjustable to fit seat backs of different sizes.

It is another related object to provide a booster seat that is integral with or releasably attached to or separate from the halter.

In one embodiment, the holder which satisfies the above as well as other objectives comprises selected ones of the following components: a halter arrangement of flexible material such as fabric which itself comprises a pocket having an open bottom edge for positioning over the back of a chair; a T-strap attached to the front of the pocket and including a crotch strap attached to the pocket and an elongated abdomen strap having opposite ends adapted for self-containment behind the pocket; a loop attached to the back surface of the pocket for securing and positioning the abdomen strap; and a neckerchief having a neck opening therein and being attached to the front side of the pocket and adapted for fitting over the shoulder and about the neck of a person seated in the associated chair and also being adapted for releasably attaching to the abdomen strap. Preferably, the halter includes a cross-bar member such as a slide mounted on said neckerchief for adjusting the size of the neck opening. Also, the pocket may include openings in its upper corners to accommodate spindle back chairs.

In a further embodiment, the present invention relates to a seat which is integrally or releasably attached to or used separately from the halter and comprises a cover; a contoured, form-fitting resilient insert of size adapted for insertion in the cover; and optionally a strap attached to the bottom of the seat and extending upwardly at the front of the seat for attachment to the T-strap to mutually secure the seat and T-strap.

In further specific aspects, the holder may comprise (1) vertically spaced cooperating fasteners along the back surface of the pocket for securing the top of the pocket in a folded-over configuration to decrease the height of the pocket and/or (2) fasteners along the bottom of the crotch strap and the seat for securing the crotch strap in a folded-over configuration to the seat. Both arrangements are used to adjust the height of the holder.

The seat insert may comprise, for example, lightweight form-retaining rubber, or plastic such as Styrofoam, or an inflatable bladder comprising one or more inflatable chambers. Alternatively, the seat may be a single member such as a bladder or foam rubber member instead of the cover and insert members.

DETAILED DESCRIPTION OF THE INVENTION

Figure 1:
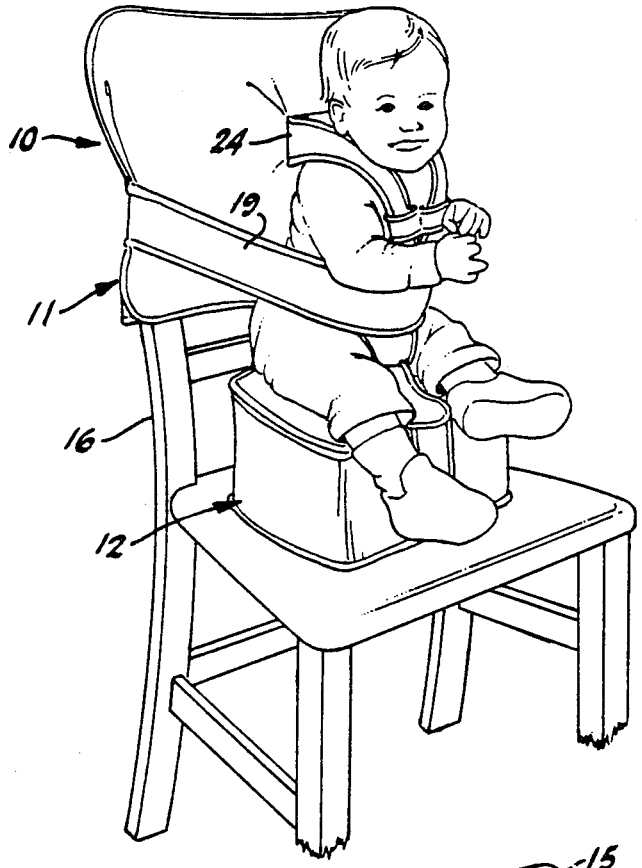
FIG. 1 is a perspective view showing the use of the child holder of the present invention to seat and safely restrain a child in a chair.
Figure 2:
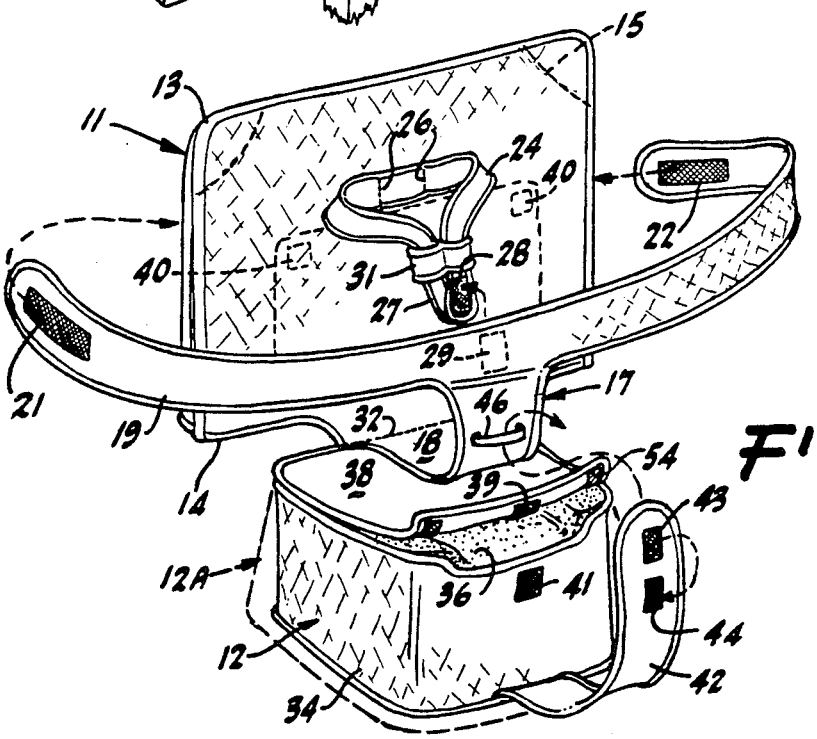
FIG. 2 is a perspective view of the child holder of FIG. 1.
Figure 3:
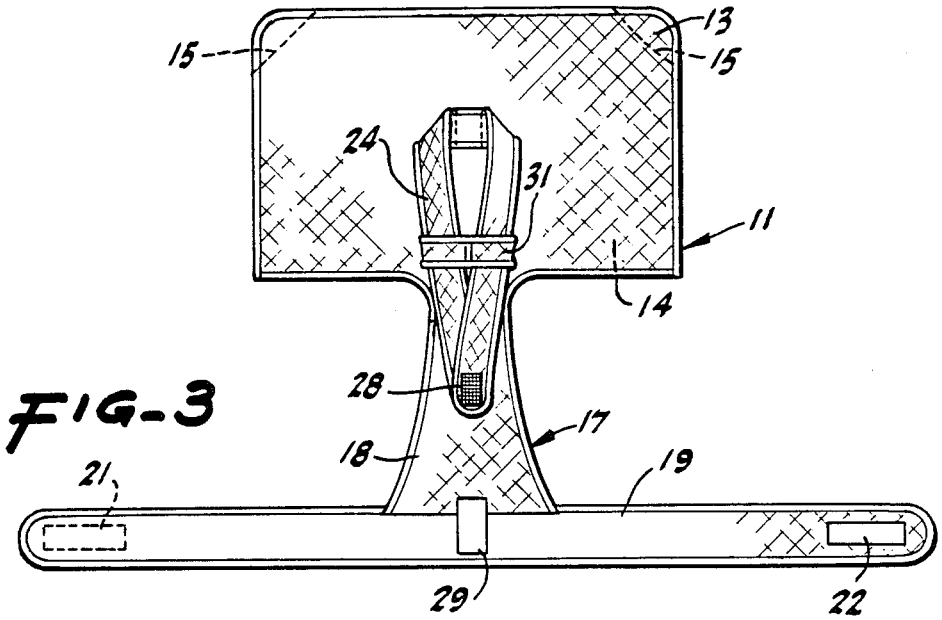
FIGS. 3 and 4 are rear and front views, respectively, of the halter arrangement of FIG. 1, shown laid out flat.
Figure 4:
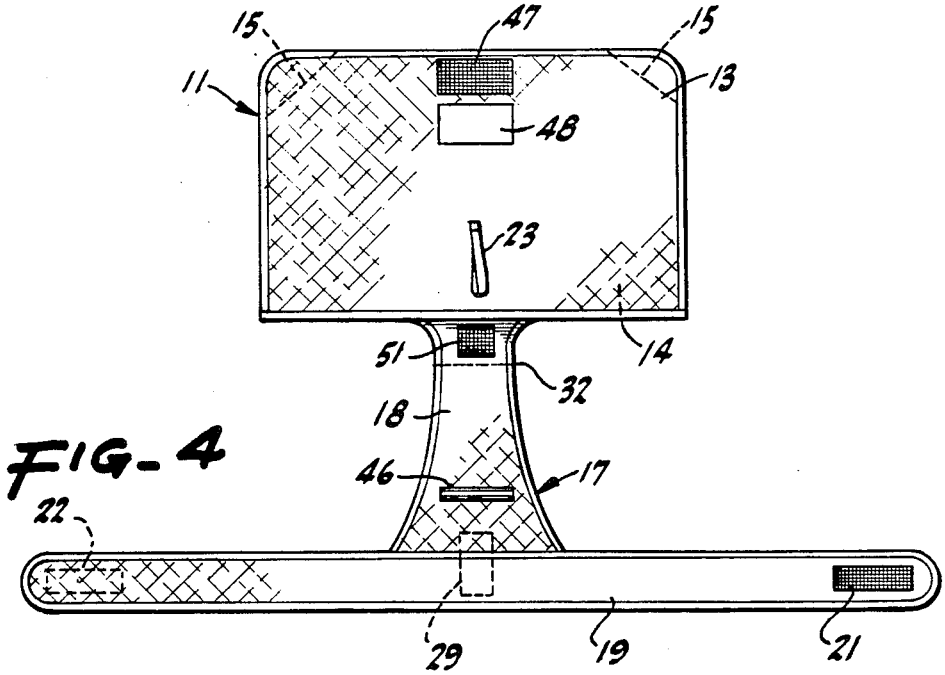

FIG. 1 depicts one embodiment of a child holder 10 which encompasses the present invention, comprising a cloth halter arrangement 11 and a booster seat 12. As is shown most clearly in FIGS. 2–6, the halter 11 includes a pocket 13 of appropriate size having an opening 14 at the bottom so that the pocket fits over the back of standard chairs 16. The pocket 13 may have cut-outs 15 at its upper edges to accommodate spindle backed chairs. The halter 11 includes a T-shaped strap arrangement 17 comprising a crotch strap 18 which is attached to or formed integrally with the bottom region of pocket 13, and an abdomen strap 19. As shown in FIGS. 2–4, preferably, the abdomen strap 19 includes mating fasteners 21 and 22 (such as Velcro TM or other hook and loop fasteners, button and holes, mating snaps and/or buckles and ties) which are attached to the opposite ends thereof for adjustably cinching the strap about a child seated in the chair 16. Loop 23, FIGS. 4–6, is attached to the rear side of the pocket 13 as an aid to properly locating the strap 19 about the abdomen and to prevent slipping of the strap 19.

Neckerchief 24 is attached to the front side of the pocket 13, as by the stitching indicated at 26, FIG. 2. The ends 27 of the neckerchief are adapted for attachment one to another or are permanently attached, and are adapted for attachment to the abdomen strap 19 at the crotch strap 18 by mating fasteners 28 and 29 which, again, may take the form of loop and hook fasteners, buttons and holes, snaps, etc. When slide 31 is used, it can be adjusted along the neckerchief 24 to provide a comfortable, secure fit about the neck and over the shoulders of the seated child. The opening of the neckerchief can be quickly changed by moving the slide, to allow greater or lesser freedom of movement without unfastening cumbersome ties, buckles, etc. Alternatively, a neckerchief can be used without the slide 31 to provide a collar opening of fixed size.

Figure 5:
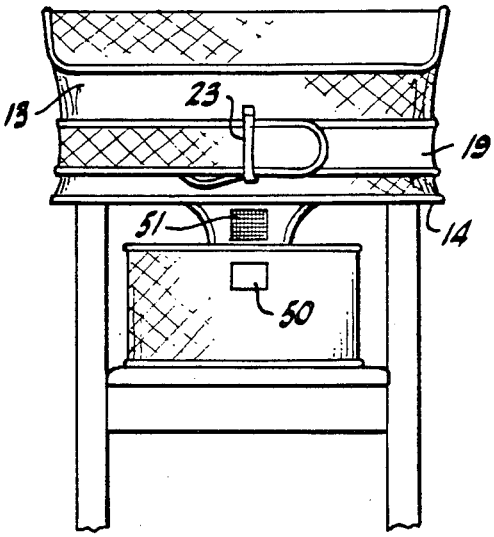
FIGS. 5 and 6 are rear and side views, respectively, of the child holder of FIG. 1, illustrating its adaptability to chairs having relatively short seat backs.
Figure 6:
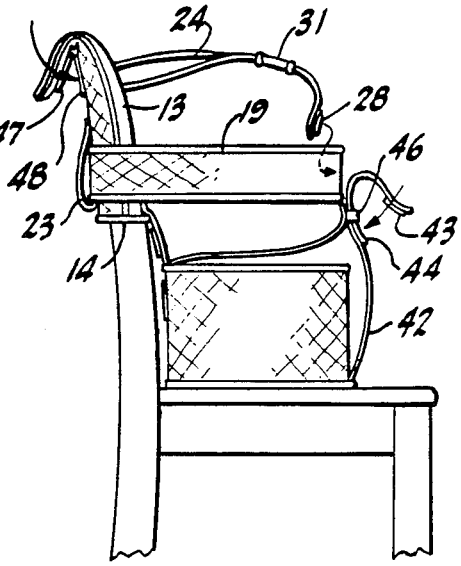
Figure 7:
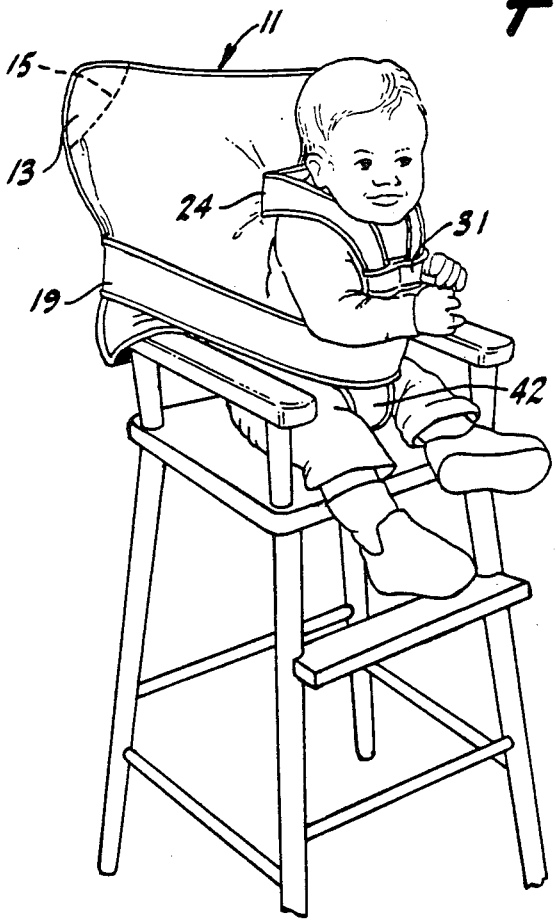
FIG. 7 is a perspective view showing the use of the halter arrangement without the seat.
Figure 10:
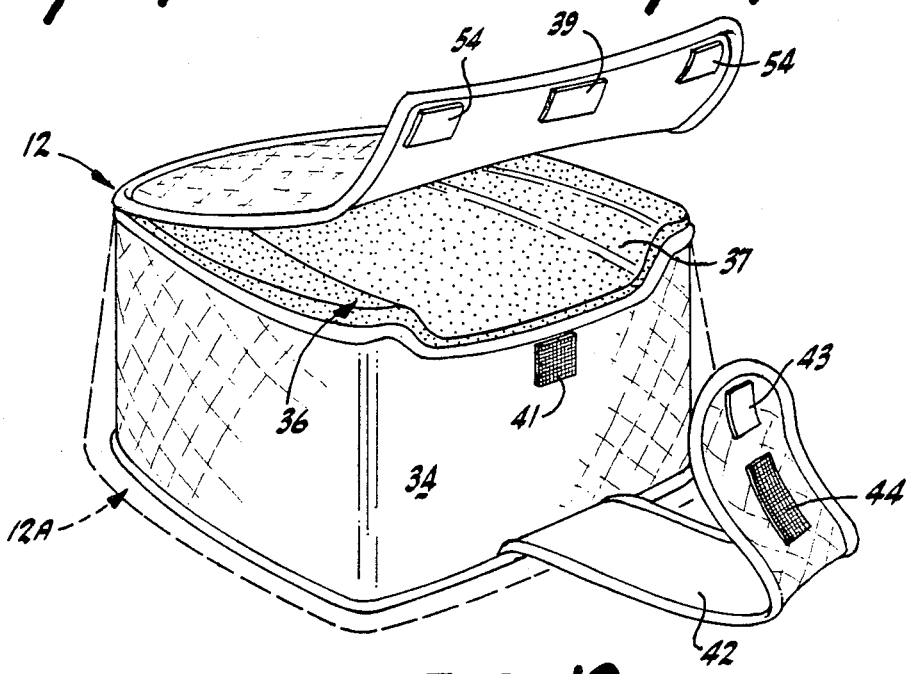
FIG. 10 is a perspective view of the seat itself.

Referring primarily to FIGS. 2, 5 and 6 and also to FIG. 10, the booster seat 12 can be separate from the halter 11, can be formed integrally with the halter 11, can be permanently attached thereto as indicated by stitching as shown schematically by line 32, FIGS. 2 and 4, or can be releasably attached to the halter along line 32 using hook- and loop-type fasteners, snaps, buttons, etc. Also, the seat can be formed with an enlarged base for even greater stability, as shown in phantom at 12A, FIG. 10. In one embodiment, typically seat 12 includes a rectangular, fabric cover 34 and a relatively resilient yet form-retaining insert 36 which preferably has an anatomically contoured upper surface 37. The insert is made of lightweight material such as rubber or Styrofoam TM or other plastic material or comprises an air-filled rubber bladder made of material such as plastic or rubber. The bladder may be formed as a single chamber or as two or more inflatable chambers. Seat cover or flap 38 is attached at the rear to the cover 34 and is closed by attachment means such as zippers or the illustrated fasteners 39,41, FIG. 10, on the inside flap and the seat front. Front strap 42 is attached to the bottom of the seat, extends vertically up the front side of the seat in use and has mating connectors 43,44, selected from various types such as those described previously. As a consequence of this structure, the strap 42 can be passed through loop 46 at the front of the crotch strap 18 and secured using the fasteners 43 and 44, to firmly restrain lateral movement of the seat relative to the crotch strap and the abdomen strap 19 and the attached neckerchief 24.

The seat may comprise a single member instead of the separate cover 12 and insert 36. That is, the seat may be a bladder or a member made of foam rubber or other suitable material.

When the seat 12 is removed from the halter 11 so that the halter can be used by itself, the seat cover 34 can be folded into the pocket 13 and attached to internal fasteners 40, FIG. 2, via the mating seat fasteners 54 or, if detachable, detached and stored separately.

Referring now in particular to FIGS. 4–6, the pocket 13 typically is of sufficient height to accommodate seat backs of different lengths. Attachment means 47,48 are mounted on the backside of the pocket 13 to secure the upper edge of the pocket 13 in a folded-over configuration, FIG. 6. As a consequence of this arrangement, the halter is readily adapted to relatively shorter seat backs (or to relatively higher chair seats).

Figure 8:
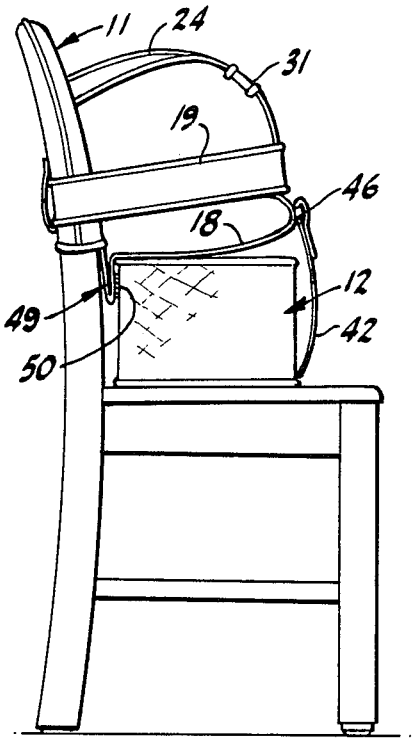
FIG. 8 is a side view showing height adjustment using the fold-over crotch strap.

FIG. 8 depicts an alternative to the approach discussed above and shown in FIGS. 5 and 6 for adjusting the seat back height or the relationship of the pocket to the seat. Here, as indicated at 49, the halter crotch strap 18 is folded over as required and the elongated halter fastener 51 (FIGS. 4 and 5) is attached to the fastener 50, on the seat back, which itself may be elongated in addition to or instead of the fastener 51 to permit maximum adjustment height. Adjustment can also be provided by using an inflatable seat or insert.

Figure 9:
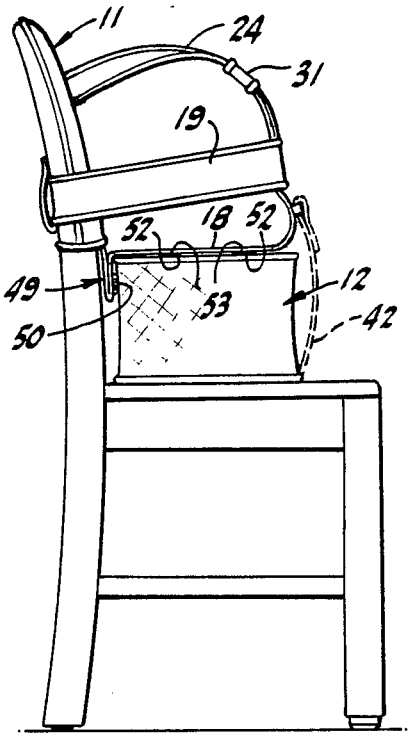
FIG. 9 is a side view showing a crotch strap which is releasably attached along its bottom surface to the seat.

FIG. 9 depicts an embodiment of the holder in which the mating fastener means 52 and 53 such as hook- and loop-type fasteners, snaps, etc., are formed along the under side of the crotch strap 18 and on the upper surface of the seat 12. Attaching the crotch strap to the seat in this manner restrains lateral movement of the seat relative to the crotch strap. Because of the enhanced lateral stability, the strap 42 is optional in this embodiment.

FIG. 10 depicts another alternative embodiment of my seat 12 which can be attached to the halter by hook- and loop-type fasteners, snaps, etc., e.g., along line 32, FIG. 2. To seat larger children or when using a chair having a relatively high seat, the seat 12 is detached from the halter 11 so that the halter 11 is used by itself, of course. The seat 12 can then be used as a separate booster chair without the halter. If necessary, and, preferably, the abdomen strap 19 can be rolled over; alternatively, the crotch strap 18 can be folded down, for height adjustment. The detached seat 12, FIG. 10, can then be used separately. Alternatively, of course, the seat can be formed without the strap 42 or the halter fasteners and used strictly by itself.

Thus, we have described a holder arrangement for children and the infirm which is specifically described for use with children but can be readily adapted in size for use with adults. The holder incorporates a body harness and a booster seat in a relatively simple, easy-to-use configuration. Moreover, the halter and seat can be integral or can be separate or releasably attached so that they can be used separately. The chair back pocket, folding seat back strap and the various straps are readily adjustable to fit children and chairs of different sizes. Also, the size of the chair back pocket can be changed to accommodate chairs of different sizes. The interconnecting adjustable-size neckerchief, abdomen strap and crotch strap provide a stable, easily adjustable harness. In addition, the harness is stabilized by and, in turn, stabilizes the booster seat.

The child restraint in the configuration described above is a portable, washable fabric halter and integral or separable booster seat that slips over the back of most conventional kitchen and dining chairs for securing and elevating infants and toddlers. The halter also fits on standard high chairs as a safety aid to eliminate the danger of smaller infants slipping out of the chair and to help restrain active children.

Having thus described preferred and alternative embodiments, what is claimed is:

1. A holder for restraining a child in a chair, comprising:

a halter arrangement of flexible material such as fabric, including: a pocket having an open bottom edge for positioning over the back of a chair; a T-shaped strap attached to the front of the pocket and including a crotch strap attached to the pocket and an elongated abdomen strap having opposite ends adapted for attachment at a common point on the back of the pocket; fastening means attached to the back surface of the pocket for securing and positioning the abdomen strap against movement relative to the pocket; a chest restraint strap having first and second sections defining a neck opening, the strap being attached intermediate the first and second strap sections to the front side of the pocket and being adapted for fitting over the shoulder and about the neck of a person seated in the chair, the first and second strap sections also being adapted for releasably attaching at a common point on the abdomen strap; and a slide mounted on the first and second strap sections for adjusting the size of the neck opening thereof to restrain movement of the child relative to the intermediate attachment point.

2. A child holder for restraining a child in a chair, comprising:

a halter arrangement of flexible material such as fabric, including: a pocket having an open bottom edge for positioning over the back of a chair; a T-shaped strap attached to the front of the pocket and including a crotch strap attached to the pocket and an elongated abdomen strap having opposite ends adapted for attachment behind the pocket; chest restraint strap means defining a neck opening, the chest restraint means being attached to the front side of the pocket and being adapted for fitting over the shoulder and about the neck of a person seated in the chair and also being adapted for releasably attaching to the abdomen strap;

a booster seat adapted for attachment to the bottom of the pocket by means selected from one of integral attachment means and releasable attachment means; and means for attaching the front of the seat to the T-strap means to restrain movement of the seat relative to the halter.

3. A child holder for restraining a child in a chair, comprising:

a halter arrangement of flexible material such as fabric, including: a pocket having an open bottom edge for positioning over the back of a chair; a T-shaped strap attached to the front of the pocket and including a crotch strap attached to the pocket and an elongated abdomen strap having opposite ends adapted for attachment behind the pocket; chest restraint strap means defining a neck opening, the chest restraint means being attached to the front side of the pocket and being adapted for fitting over the shoulder and about the neck of a person seated in the chair and also being adapted for releasably attaching to the abdomen strap; and a seat adapted for attachment to the bottom of the pocket by means selected from one of integral attachment means and releasable attachment means and further comprising a strap extending upwardly at the front of the seat and being adapted for attachment to the T-strap to mutually secure the seat and halter against relative lateral movement.

4. The holder of claim 3, wherein the abdomen strap includes a loop for securing the front seat strap.

5. The holder of claim 2 or 3, wherein the seat further comprises a cover and a form-holding relatively resilient insert of size for insertion into the cover, the cover having a flap adapted for releasable attachment for allowing insertion and removal of the insert.

6. The holder of claim 5, wherein the insert is an inflatable bladder comprising at least one inflatable chamber.

7. The holder of claim 5, wherein the seat cover is foldable, the seat cover and the halter are formed integrally and the pocket includes attachment means therein for retaining the cover therein when not in use.

8. The holder of claim 2 or 3, wherein the seat is a unitary member.

9. The holder of claim 8, wherein the seat comprises an inflatable bladder having at least one inflatable chamber.

10. The holder of claim 2 or 3, wherein the seat and halter are formed integrally.

11. The holder of claim 2 or 3, wherein the seat includes a base enlarged relative to the top thereof for enhanced stability.

12. The holder of claim 2 or 3, wherein the top of the seat is anatomically contoured.

13. The holder of claim 2 or 3, wherein the halter further comprises a loop attached to the back surface of the pocket for securing and positioning the abdomen strap.

14. The holder of claim 2 or 3, further comprising a slide mounted on the chest restraint strap means for adjusting the size of the associated neck opening.

15. The holder of claim 1, 2 or 3, wherein the pocket comprises at least a pair of vertically spaced cooperating fastener means along the backside for securing the top of the pocket in a fold-over configuration to decrease the height of the pocket.

* * * * *